US006367533B1

(12) United States Patent
Pitzen

(10) Patent No.: US 6,367,533 B1
(45) Date of Patent: Apr. 9, 2002

(54) SAFE CUT-OFF BLADE ASSEMBLY

(75) Inventor: James F. Pitzen, Maplewood, MN (US)

(73) Assignee: 3M Innovative Properties Company, St Paul, MN (US)

( * ) Notice: Subject to any disclaimer, the term of this patent is extended or adjusted under 35 U.S.C. 154(b) by 0 days.

(21) Appl. No.: 09/362,634

(22) Filed: Jul. 21, 1999

(51) Int. Cl.[7] ..... B32B 31/00; B26B 13/00; B26B 19/00; B26B 21/00; B26B 29/00

(52) U.S. Cl. ..... 156/527; 156/579; 7/112; 7/113; 83/835; 83/853; 83/854; 83/855; 76/106.5; 76/104.1; 76/119; 225/19; 225/91; 30/504; 30/288; 30/355; 30/357; 30/82; 30/346.56

(58) Field of Search ..... 225/19, 91; 156/527, 156/579; 30/504, 288, 355, 357, 346.56, 82; 76/106.5, 104.1, 119; D7/650, 652; 7/112, 113; 83/835, 853, 854, 855

(56) References Cited

U.S. PATENT DOCUMENTS

| | | | | |
|---|---|---|---|---|
| 2,043,998 A | | 6/1936 | Hadjopoulos | 30/48 |
| 3,567,557 A | | 3/1971 | Kingery et al. | 156/523 |
| 3,797,110 A | | 3/1974 | Michelson | 30/82 |
| 4,175,685 A | | 11/1979 | Niles | 225/19 |
| 4,426,029 A | | 1/1984 | Kamp | 225/49 |
| 4,458,570 A | * | 7/1984 | Morrison | 83/375 |
| 4,913,767 A | | 4/1990 | Longworth | 156/527 |
| 4,915,768 A | | 4/1990 | Söderberg | 156/527 |
| 4,989,769 A | | 2/1991 | Longworth et al. | 225/20 |
| 4,990,214 A | | 2/1991 | Heil et al. | 156/527 |
| 5,113,921 A | | 5/1992 | Pool | 156/71 |
| 5,297,342 A | * | 3/1994 | Malone | 30/233 |
| 5,504,997 A | * | 4/1996 | Lee | 30/34.1 |

FOREIGN PATENT DOCUMENTS

| | | | |
|---|---|---|---|
| DE | 297 20 059 | * | 2/1998 |
| WO | WO 98/51630 | | 11/1998 |

* cited by examiner

*Primary Examiner*—Linda Gray
(74) *Attorney, Agent, or Firm*—William L Huebsch

(57) ABSTRACT

A cut-off blade assembly including a thin metal blade having an attachment portion by which the cut-off blade assembly can be attached to a dispenser, and a plurality of projecting similarly shaped triangular primary teeth. The triangular primary teeth each have two sides terminating in points and have bases adjacent the attachment portion that are aligned in a first direction along the blade so that their points project generally at right angles to that first direction. Edge surfaces on the sides and at the points of the primary teeth intersect a major surface of the primary teeth at an included angle of no greater than about 90 degrees to define a cutting edge at that intersection. The cut-off blade assembly further includes projections along one major surface of the primary teeth. Those projections have distal ends positioned adjacent the points of the primary teeth, have sufficient thickness at the points in a direction normal to the major surfaces of the primary teeth to restrict inadvertent contact between a person and the cutting edge of the cutting blade, and are shaped and positioned to extend only along the primary teeth to afford easy cutting of sheet material pressed against the cutting edge of the primary teeth and free movement of the end of the sheet material being cut over the primary teeth. The primary teeth may intersect each other, or may be spaced apart and the blade may include recessed secondary teeth defining portions of the cutting edge therebetween.

20 Claims, 4 Drawing Sheets

SAFE CUT-OFF BLADE ASSEMBLY

FIELD OF THE INVENTION

The present invention relates to cut-off blades for cutting sheet material and to such cut-off blades used on dispensers that have sharp cutting edges defined by spaced projecting teeth that are adapted for transversely cutting dispensed lengths of the sheet materials from supplies of the sheet materials carried by the dispensers.

DESCRIPTION OF THE INVENTION

The art is replete with dispensers including cut-off blades having sharp cutting edges adapted for transversely cutting dispensed lengths of sheet materials from supplies of the sheet materials carried by the dispensers. U.S. Pat. Nos. 3,567,557, 4,096,021, and 4,915,768 provide illustrative examples. The cut-off blades on some of those dispensers provide a potential source of injury for persons using the dispensers, particularly if the cut-off blades have sharp spaced projecting teeth such as those on a cut-off blade described in U.S. Pat. No. 4,913,767 that is adapted to pierce and cut folded polymeric sheet material. A guard described in U.S. Pat. No. 4,989,769 can be provided for such a cut-off blade, however, such guards must be moved from over the cut-off blade before the blade can be used to cut, which can be a slight inconvenience. Such moveable blade guards have been removed by workmen that are less concerned with safety than with the ease of using the dispenser. International Application WO 98/51603 discloses other, less easily removable but generally more complex structures for transversely cutting dispensed lengths of sheet materials from supplies of the sheet materials carried on dispensers. Those structures protect a user of the dispenser from a cutting member or cut-off blade between its uses to cut sheet material by moving the cut-off blade to a position where it will not be easily contacted by a person handling the dispenser, while affording convenient movement of the cut-off blade to a cutting position that affords easy efficient severing of the sheet materials when that is desired.

SUMMARY OF THE INVENTION

The present invention provides a cut-off blade assembly that is useful on dispensers of the types described above for transversely cutting dispensed lengths of sheet materials; which cut-off blade assembly affords easy efficient severing of the sheet material including folded polymeric sheet material, involves no moving parts, and yet provides significant protection to a user of the dispenser against injury caused by accidental contact with the cut-off blade assembly.

The cut-off blade assembly according to the present invention comprises a thin metal blade including an attachment portion by which the cut-off blade assembly can be attached to a dispenser, and a plurality of projecting similarly shaped triangular primary teeth. The teeth each have two sides terminating in points and have bases adjacent the attachment portion that are aligned in a first direction along the blade so that their points project generally at right angles to that first direction. Edge surfaces on the sides and at the points of the primary teeth intersect a major surface of the teeth at an included angle of no greater than about 90 degrees to define at least a portion of a cutting edge for the blade at that intersection. The cut-off blade assembly further includes projections along one major surface of the primary teeth. Those projections have distal ends positioned adjacent the points of the teeth (e.g., spaced about 0.01 inch or 0.025 centimeter away from the points along the primary teeth), have sufficient thickness at the points in a direction normal to the major surfaces of the teeth to restrict contact between a person and the cutting edge on the points of the primary teeth, and are shaped and positioned so that they extend only along the primary teeth to afford easy cutting of sheet material pressed against the cutting edge of the blade and free movement of the end of the sheet material being cut over the primary teeth.

The sides of adjacent primary teeth can intersect at the bases of the adjacent primary teeth to define a generally V shaped opening therebetween, or the adjacent primary teeth can be spaced appart and the blade can include portions (e.g., a plurality of (e.g., 4 or 5) recessed smaller secondary teeth) defining parts of the cutting edge for the blade between the adjacent primary teeth.

Such use of projections to restrict contact of a person with the cutting edge at the points on the primary teeth provides significant protection for a user of the dispenser on which the cut-off blade assembly is mounted. Those points are the parts of the blade that can make inadvertent contact with a persons flesh; whereas the recessed portions of the cutting edge along edges of the primary teeth between their points and along recessed portions of the blade (if any) beween primary teeth spaced up to about 0.4 inch or 1 centimeter appart will typically not make contact with a persons flesh if the projections restrict the points of the primary teeth from becoming imbeded in it. If a person using the cut-off blade assembly accidentally forces his flesh against its cutting edge, the projections on the primary teeth push his skin away, thereby preventing or minimizing penetration of his skin by the blade and limiting any injury that may be sustained to a scratch or shallow cut; whereas the same contact with the blade without the projections could result in a cut requireing medical attention.

The thickness of the projections at the points should be at least 0.02 inch or 0.05 centimeter thick to provide a measure of safety for the user, and preferably the projections are about 0.03 inch or 0.07 centimeter thick at their points which provides a good combination of safety for the user with ease of cutting of sheet material by the cut-off blade assembly.

The projections can project from a base portion of a layer of material in which the projections are included. The base portion can then be attached along the surface of the blade with the projections projecting over the primary teeth.

The cut-off blade assembly is, for example, useful on the type of dispenser called a masking machine or device, one embodiment of which is described in U.S. Pat. No. 4,990,214.

BRIEF DESCRIPTION OF THE DRAWING

The present invention will be further described with reference to the accompanying drawing wherein like reference numerals refer to like parts in the several views, and wherein.

DETAILED DESCRIPTION

Figure 1:
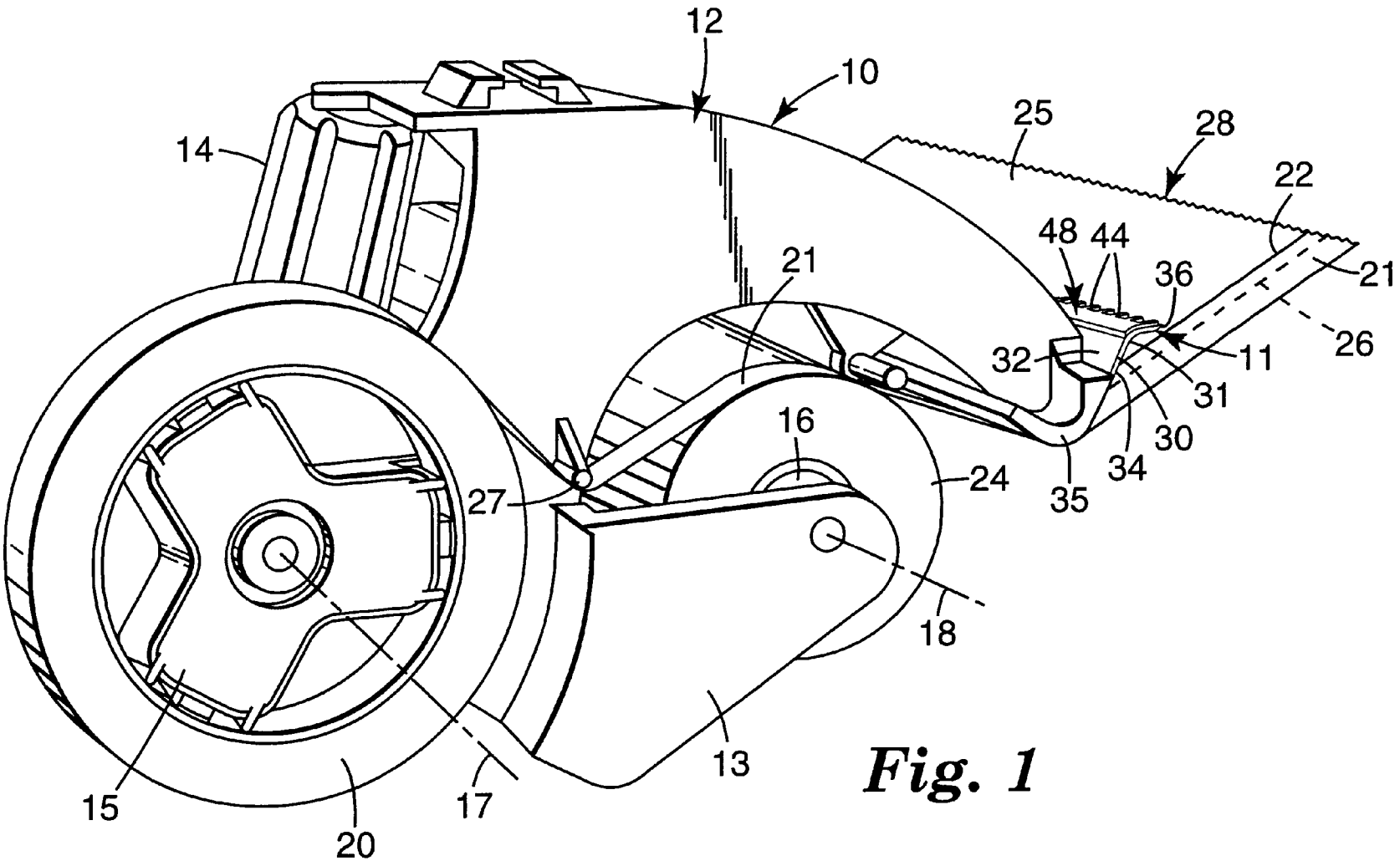
FIG. 1 is a perspective view of a dispenser including a first embodiment cut-off blade assembly according to the present invention.

Referring now to FIG. 1 of the drawing, there is shown a dispenser 10 including a cut-off blade assembly 11 according to the present invention. The dispenser 10 is a type of dispenser called a masking machine or device that is described in U.S. Pat. No. 4,990,214 (the content whereof is incorporated herein by reference), one embodiment of which is sold my Minnesota Mining and Manufacturing Company, St., Paul, Minn. under the trade designation HAND-MASKER (t.m.) M3000 Dispenser. Generally, that dispenser 10 includes a polymeric frame 12 including a hub support frame member 13 and a handle 14 adopted for manual engagement to manipulate the dispenser 10. First and second hubs 15 and 16 are mounted on the hub support frame member 13 for rotation about spaced generally parallel axes 17 and 18. The first hub 15 is adapted to receive a roll 20 of tape 21 and to position a first edge 22 of a length of the tape 21 withdrawn from the roll 20 at a first predetermined position axially with respect to the first and second hubs 15 and 16 with the opposite second edge of that withdrawn length of tape 21 projecting past the frame 12. The second hub 16 is adapted to receive a roll 24 of masking material 25 and to position a first edge 26 of the length of masking material 25 at a second predetermined position axially with respect to the first and second hubs 15 and 16 with the width of the length of tape 21 extending from the first position past the second position and the width of the length of masking material 25 extending from the second position past the first position. A portion of the length of tape 21 along the first edge 22 of the length of tape and a portion of the length of masking material 25 along the first edge 26 of the length of masking material 25 are both positioned between those first and second positions. The dispenser 10 includes means including a guide pin 27 that defines a path for the length of tape 21 from the roll 20 of tape 21 to the periphery of the roll 24 of masking material 25 where the portion of tape 21 along the first edge 22 of the length of tape 21 is adhered to the portion of the masking material 25 along the first edge 26 of the length of masking material 25. Such adhesion of the tape 21 to the masking material 25 along the periphery of the roll 24 of masking material 25 forms a composite masking sheet material 28 having opposite edges defined by the second edges of the length of tape 21 and the length of masking material 25 and an exposed portion of the coating of pressure sensitive adhesive along the second edge on the length of tape 21 along one major surface of the composite masking sheet material 28 so that the exposed portion of the coating of adhesive can be adhered along a surface to be masked to hold the composite masking sheet 28 in a desired position.

The frame 12 defines a passageway on the device 10 through which a person may pull the composite masking sheet material 28 from the supply of composite masking sheet material 28 formed at the periphery of the roll 24 of masking material. The cut-off blade assembly 11 (see FIGS. 1, 2, 3 and 4) comprises a thin metal blade 30 (e.g., made of 0.018 inch or 0.05 centimeter thick sheet steel) that has parallel opposite first and second major surfaces 31 and 32 and edge surfaces 33 extending between those major surfaces 31 and 32. The metal blade 30 has an attachment portion 34 that is curved along its length to have a generally J-shaped cross section and is removeably attached to a member 35 of the frame 12. The cut-off blade assembly 11 extends generally parallel to the axes 17 and 18 of the hubs 15 and 16 and defines a first side of the passageway. A user of the dispenser 10 can manually tension the composite masking sheet material 28 being pulled from the roll 24 around a row of similarly shaped projecting primary teeth 36 included in the blade 30. The teeth 36 will then pierce and transversely sever the tensioned composite masking sheet material 28 along a cutting edge 37 on the blade 30 as that composite masking sheet material 28 is pulled away from the dispenser 10.

The cut-off blade assembly 11 is removably attached to the frame member 35 by means described in U.S. Pat. No. 4,990,214 which briefly comprises one side of one end portion of the J-shaped attachment portion 34 of the blade 30 being hooked around the member 35 of the polymeric part of the frame 12 that is adapted to fit in that end portion and to be retained in that end portion by a pin (not shown) that projects from the member 35 through an opening in the blade 30. The cut-off blade assembly 11 can be removed from the member 35 by manually pressing on it so that the blade 30 resiliently bends and flexes over the pin 40, whereupon the blade 30 can be unhooked from the member 35.

Figure 2:
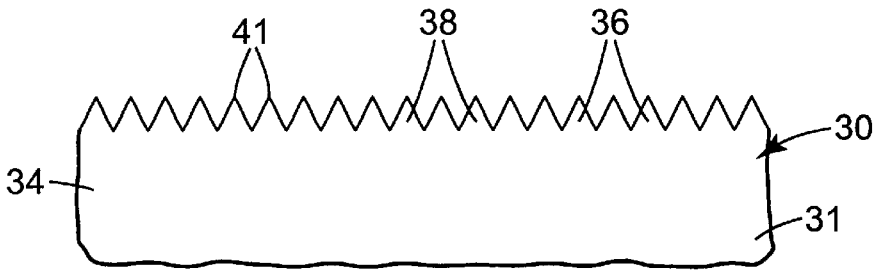
FIG. 2 is an enlarged fragmentary bottom view of the cut-off blade assembly shown in FIG. 1.
Figure 3:
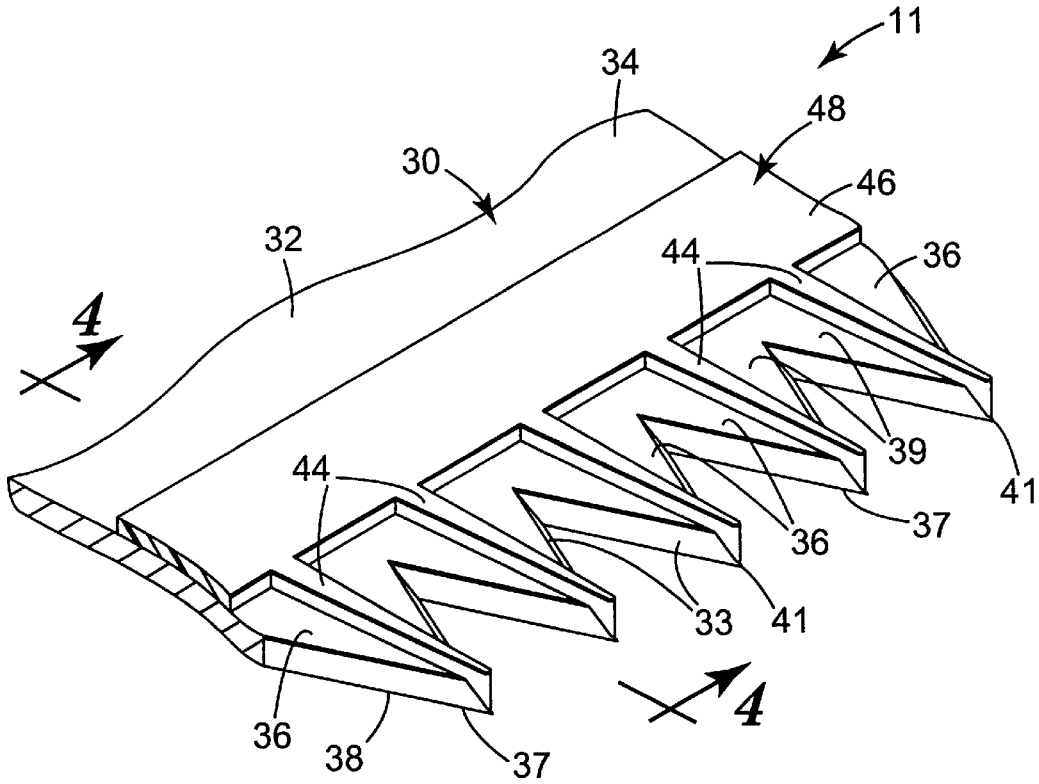
FIG. 3 is an enlarged fragmentary perspective top view of the cut-off blade assembly shown in FIGS. 1 and 2.

The teeth 36 on the blade 30 are similar in shape to the teeth described in U.S. Pat. No. 4,913,767 (the content whereof is incorporated herein by reference) and can be made by the method described in that patent. As is best seen in FIG. 2, bottom major surfaces 38 of the primary teeth 36 are triangular parts of the first major surface 31 of the blade 30, whereas opposite top major surfaces 39 of the primary teeth 36 are triangular parts of the second major surface 32 of the blade 30 as can be seen in FIG. 3. The primary teeth 36 each have two sides terminating in a point 41 and a base adjacent the attachment portion 34 of the blade 30. The bases of the primary teeth 36 are aligned in a first direction along the blade 30 so that the points 41 of the teeth 36 project generally at right angles to that first direction. The sides of adjacent primary teeth 36 intersect at the bases of adjacent teeth 36 to define generally V shaped openings between the adjacent primary teeth 36. As can be seen in FIG. 3, the edge surfaces 33 along the sides of the primary teeth 36 are disposed at included angles of no greater than about 90 degrees (about 30 degrees as illustrated) with respect to the bottom surfaces 38 of the teeth 36 to define the cutting edge 37 at the intersection of those bottom surfaces 38 and the edge surface 33 along the sides and points 41 of the adjacent teeth 36. The points 41 of the primary teeth 36 can pierce the composite masking sheet material 28 when that sheet material 28 is pulled across the primary teeth 36 from their bottom surfaces 38, and further tension applied on the composite masking sheet material 28 will cause the primary teeth 36 to further penetrate the composite masking sheet material 28 until the composite masking sheet material 28 is completely severed by the cutting edge 37. The blade assembly 11 is particularly useful for severing folded polymeric sheet material of the type described in U.S. Pat. No. 5,113,921, the content whereof is hereby incorporated herein by reference. Such piercing by the primary teeth 36 will advantageously help to maintain the relative position of the layers of folded polymeric sheet material while it is being cut.

Protection from inadvertent contact with the cutting edge 37 of the blade 30 is provided by projections 44 along the top surfaces 39 and edge surfaces 33 of the primary teeth 36 (see FIGS. 3 and 40). Those projections project from a base portion 46 of a layer of material 48 (e.g., of a polymeric material such as polycarbonate or of a metal) in which the projections 44 are included. The base portion 46 is attached (e.g., by an adhesive or mechanical fasteners) along the second major surface 32 of the blade 30 with the projections 44 projecting over the primary teeth 36. The projections 44 have distal ends positioned adjacent the points 41 of the primary teeth 36 (e.g., positioned directly above the points 41 or, preferably, spaced away from the points 41 along the surface of the teeth 36 by about 0.01 inch or 0.025 centimeter), and have sufficient thickness at those points 41 in a direction normal to the top surfaces 39 of the primary teeth 36 to restrict contact between the cutting edge 37 at the points 41 of the primary teeth 36 and the flesh of a person that might inadvertantly contact the cut-off blade assembly 11 (e.g., the projections 44 can be about 0.03 inch or 0.07 centimeter thick adjacent the points which provides a good combination of safety for the user and ease of cutting of the composite masking material 28 by the cut-off blade assembly 11). The projections 44 are shaped and positioned to extend only along the top and edge surfaces 39 and 33 of the primary teeth 36 (i.e., not over the V-shaped openings between the teeth 36), thereby facilitating cutting of the composite masking material 28 when it is pressed against the cutting edge 37 along the bottom surfaces 38 of the primary teeth 36 by affording free movement of the end of the masking material 28 being cut over the teeth 36 and through those V shaped openings. Specifically, as illustrated, the projections 44 can have maximum widths of about 0.03 in or 0.07 centimeter in a direction parallel to the first and second major surfaces 31 and 32, and can be tapered to have widths generally corresponding with the sides of the primary teeth 36 adjacent their points 41. Also, the base portion 46 is preferably spaced at least 0.06 inch or 0.15 centimeter away from the inner ends of the V-shaped openings between the primary teeth 36 to limit its interfearance with the cutting action of the teeth 36.

The thickness of the base portion 46 and of the projections 44 adjacent their proximal ends can be at least 0.06 inch or 0.15 centimeter to provide adequate strength for them.

Figure 4:
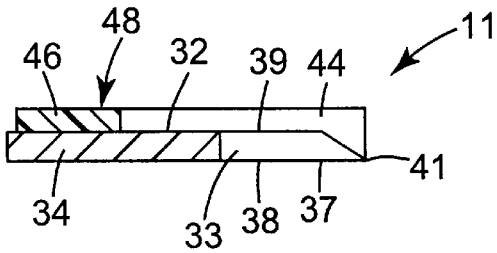
FIG. 4 is a sectional view taken approximately along line 4—4 of FIG. 3.

The tapered sides of the projections 44 can be aligned directly above the adjacent sides of the primary teeth 36 over which they project. Alternatively, but less desirably, the tapered sides of the projections 44 can be spaced along the top surfaces 39 from the adjacent sides of the primary teeth 36 over which they project by about 0.01 inch or 0.025 centimeter without seriously degrading the protection provided by the projections 44. Also, as illustrated in FIG. 4, the surfaces of the projections 44 adjacent the primary teeth 36 can conform in shape to and lay against the edge surfaces 33 of the blade 30 adjacent the points 41 of the primary teeth 36. Alternatively, the surfaces of the projections 44 adjacent the primary teeth 36 can be spaced from the points 41 of the primary teeth 36 by the thickness of the blade 30.

Figure 5:
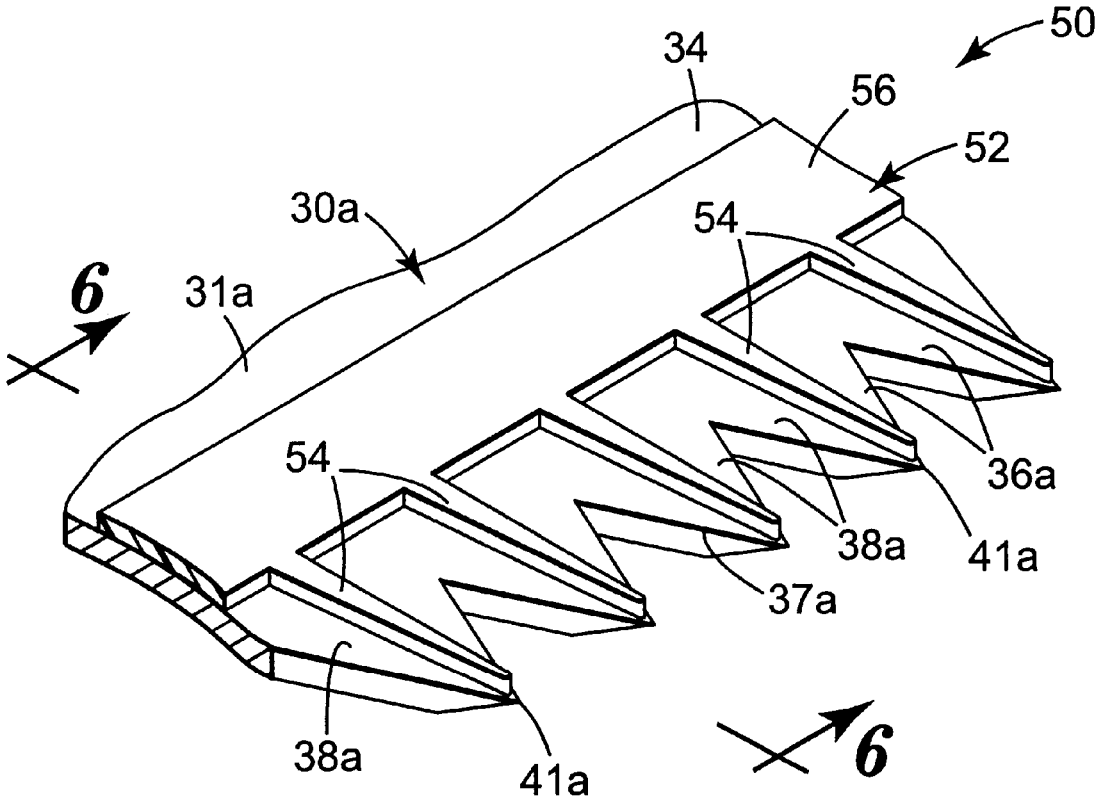
FIG. 5 is a fragmentary perspective view of a second embodiment of a cut-off blade assembly according to the present invention.
Figure 6:
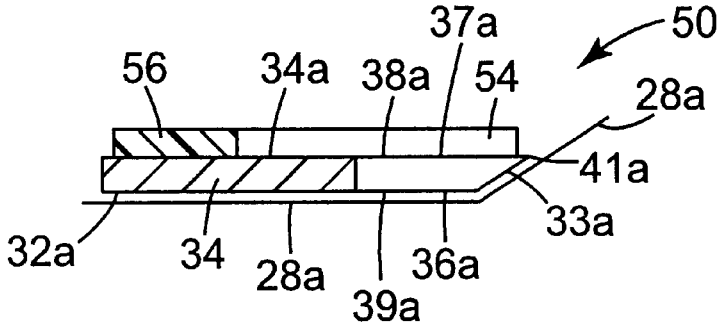
FIG. 6 is a sectional view taken approximately along line 6—6 of FIG. 5.

FIGS. 5 and 6 illustrate a second embodiment of a cut-off blade assembly 50 according to the present invention. The cut-off blade assembly 50 includes the same metal blade 30 including the attachment portion 34 and the primary teeth 36 that is included in the cut-off blade assembly 11 (the structural elements of the metal blade 30 including those of the primary teeth 36 being identified hereinafter and in FIGS. 5 and 6 of the drawing by the same reference numerals used with reference to the cut-off blade assembly 11 with the addition of the suffix "a"). The cut-off blade assembly 50 also includes a layer of material 52 having projections 54 from a base portion 56 that have almost the same shape as and provide the same function of protecting a person from being seriously injured by the blade assembly 50 as the layer of material 48 with its base portion 46 and projections 44 of the cut-off blade assembly 11. The cut-off blade assembly 50 primarily differs from the cut-off blade assembly 11 in that the base portion 56 of the layer of material 52 is attached along the first major surface 31*a* of the blade 30*a* so that its projections 54 project along the bottom major surfaces 38*a* of the primary teeth 36*a*. As is schematically illustrated in FIG. 6, the cut-off blade assembly 50 can be used to cut a sheet of composite masking material 28*a* pulled across the points 41*a* of the primary teeth 36*a* from their top and edge surfaces 39*a* and 33*a*, after which further tension applied on the composite masking sheet material 28*a* will cause the teeth 36*a* to further penetrate the composite masking sheet material 28*a* until the composite masking sheet material 28*a* is completely severed by the cutting edge 37*a*. While the cut-off blade assembly 50 works reasonably well, the cut-off blade assembly 11 with the blade 30 of the same structure and the projections 44 along its second surface 32 cuts more easily and is preferred over the blade assembly 50.

Figure 7:
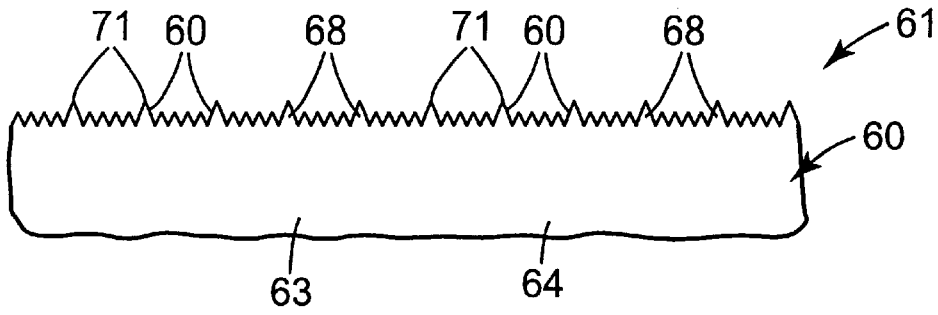
FIG. 7 is a fragmentary bottom view of a third embodiment of a cut-off blade assembly according to the present invention.
Figure 8:
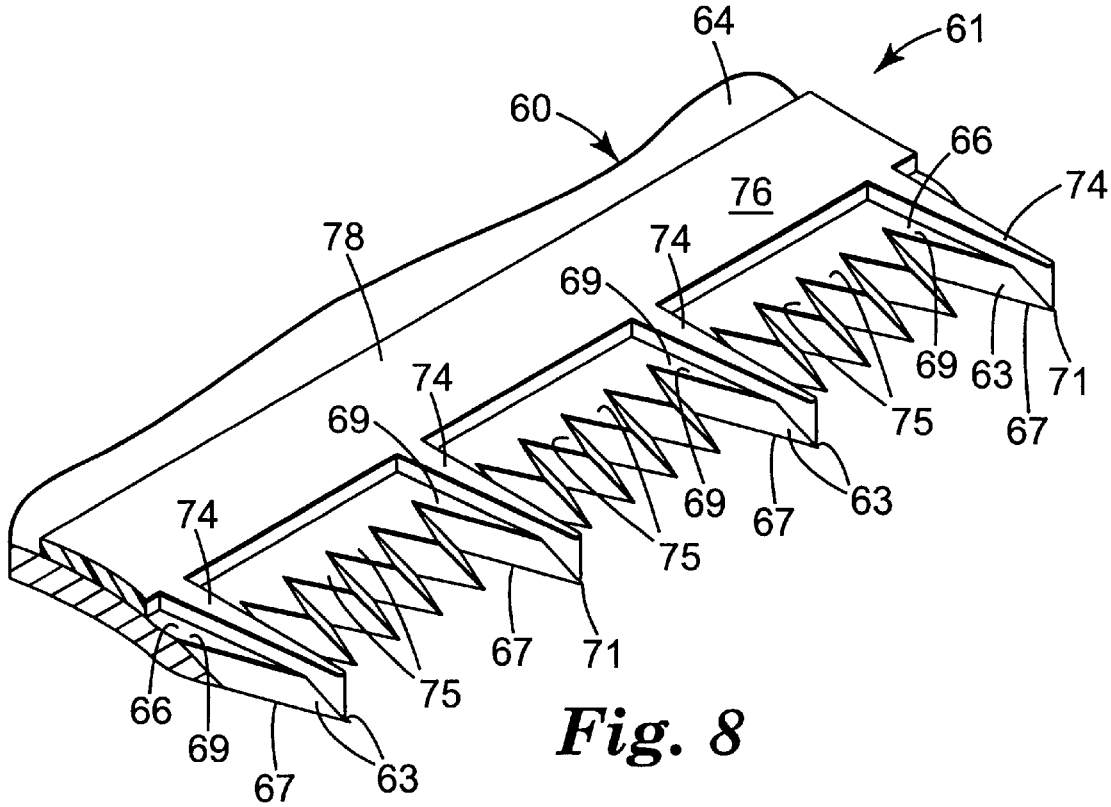
FIG. 8 is an enlarged fragmentary perspective top view of the cut-off blade assembly shown in FIG. 7.

FIGS. 7 and 8 illustrate a third embodiment of a cut-off blade assembly according to the present invention generally designated by the reference numeral 61. The cut-off blade assembly 61 includes a blade 60 including primary teeth 66 that are similar in shape to the primary teeth 36 on the blade 30 described above. Similarly, bottom major surfaces 68 of the primary teeth 66 are triangular parts of a first major surface 63 of the blade 60 (see FIG. 7), whereas opposite top major surfaces 69 of the primary teeth 66 are triangular parts of a second major surface 62 of the blade 60 (see FIG. 8). The primary teeth 66 each have two sides terminating in a point 71 and a base adjacent an attachment portion 64 of the blade 60. The bases of the primary teeth 66 are aligned in a first direction along the blade 60 so that the points 71 of the teeth 66 project generally at right angles to that first direction. The edge surfaces 63 along the sides of the primary teeth 66 are disposed at included angles of no greater than about 90 degrees (about 30 degrees as illustrated) with respect to the bottom surfaces 68 of the teeth 66 to define a portion of a cutting edge 67 for the blade 60 at the intersection of those bottom surfaces 68 and the edge surface 63 along the sides and points 71 of the primary teeth 66.

Unlike the teeth 36 on the blade 30, however, the points 71 of adjacent primary teeth 66 of the blade 60 are spaced appart, and the blade 60 includes portions defining portions of the cutting edge 67 for the blade 60 between the adjacent primary teeth 66. As illustrated, those portions defining portions of the cutting edge 67 for the blade 60 between the adjacent primary teeth 66 can comprise a plurality of (e.g., four as illustrated, more or less could be used) secondary teeth 75 having points projecting generally a right angles to the first direction and spaced or recessed from the points 71 of the primary teeth 66. The edge surfaces along the sides of the secondary teeth 75 are also disposed at included angles of no greater than about 90 degrees (about 30 degrees as illustrated) with respect to the bottom surfaces 68 of the secondary teeth 75 to help define the cutting edge 67 for the blade 60 at the intersection of those bottom surfaces 68 and the edge surfaces along the sides and points of the secondary teeth 75. The points 71 of the primary teeth 66 can then pierce the composite masking sheet material 28 when that sheet material 28 is pulled across the primary teeth 66 from their bottom surfaces 68 (which piercing will advantageously help to maintain the relative position of the layers of folded polymeric sheet material while it is being cut), and further tension applied on the composite masking sheet material 28 will cause the primary teeth 66 to further penetrate the composite masking sheet material 28 until the composite masking sheet material 28 is completely severed by the cutting edge 67 on the primary and secondary teeth 66 and 75.

Protection from inadvertent contact with the cutting edge 67 of the blade 60 is provided by projections 74 along the top surfaces 69 and edge surfaces 63 of the primary teeth 66. Those projections project from a base portion 76 of a layer of material 78 (e.g., of a polymeric material such as polycarbonate or of a metal) in which the projections 74 are included. The base portion 76 is attached (e.g., by an adhesive or mechanical fasteners) along the second major surface 64 of the blade 60 with the projections 74 projecting over the primary teeth 66. The projections 74 have distal ends positioned adjacent the points 71 of the primary teeth 66 (e.g., positioned directly above the points 71 or, preferably, spaced away from the points 71 along the surface of the teeth 66 by about 0.01 inch or 0.025 centimeter), and have sufficient thickness at those points 71 in a direction normal to the top surfaces 69 of the primary teeth 66 to restrict contact between the cutting edge 67 at the points 71 of the primary teeth 66 and the flesh of a person that might inadvertantly contact the cut-off blade assembly 61 (e.g., the projections 74 can be about 0.03 inch or 0.07 centimeter thick adjacent the points which provides a good combination of safety for the user and ease of cutting of the composite masking material 28 by the cut-off blade assembly 61). The projections 74 are shaped and positioned to extend only along the top and edge surfaces 69 and 63 of the primary teeth 66 (i.e., not over the secondary teeth 75 between the primary teeth 66), thereby facilitating cutting of the composite masking material 28 when it is pressed against the cutting edge 67 along the primary teeth 66 and the secondary teeth 75 by affording free movement of the masking material 28 being cut over the primary and secondary teeth 66 and 75. The spacing between the points 71 of the primary teeth 66 is not sufficiently large that a person using the cut-off blade assembly 61 can easily come in contact with the cutting edge 67 between the primary teeth 66. As an example, the points of adjacent primary teeth 66 can be spaced appart by a distance up to about 0.4 inch or 1 centimeter and preferably in the range of about 0.27 to 0.32 inch or 0.7 to 0.8 centimeter to provide that protection. The primary teeth 66 can have widths at their bases of about 0.09 inch or 0.23 centimeter and heights between their bases and their points of about 0.13 inch or 0.33 centimeter, and the secondary teeth can have points projecting generally a right angles to the first direction, which points of the secondary teeth are recessed or spaced from the points of the primary teeth by about 0.065 inch or 0.17 centimeter. The projections 74 can have maximum widths of about 0.03 in or 0.07 centimeter in a direction parallel to the first major surface 61 and can be tapered to have widths generally corresponding with the sides of the primary teeth 66 adjacent their points 71. Also, the base portion 76 can be spaced at least 0.06 inch or 0.15 centimeter away from the inner ends of the V-shaped openings between the primary and secondary teeth 66 and 75 to limit its interfearance with the cutting action of the teeth 66 and 75.

Because the primary teeth 66 are spaced farther apart on the blade 60 then are the primary teeth 36 on the blade 11, the primary teeth 66 on the blade 60 will more easily pierce the same type of composite masking sheet material 28 when that sheet material 28 is pulled across the primary teeth 66 from their bottom surfaces 68 than will the primary teeth 36 on the blade 11. Any interference to such piercing by the presence of the projections 74 will be minimized. Further tension applied on the composite masking sheet material 28 will cause the primary teeth 66 and secondary teeth 75 to penetrate the composite masking sheet material 28 until the composite masking sheet material 28 is completely severed by the cutting edge 67 on the primary and secondary teeth 66 and 75.

The thickness of the base portion 76 and of the projections 74 adjacent their proximal ends can be at least 0.06 inch or 0.15 centimeter to provide adequate strength for them.

The tapered sides of the projections 74 can be aligned directly above the adjacent sides of the primary teeth 66 over which they project. Alternatively, but less desirably, the tapered sides of the projections 74 can be spaced along the top surfaces 69 from the adjacent sides of the primary teeth 66 over which they project by about 0.01 inch or 0.025 centimeter without seriously degrading the protection provided by the projections 74. Also, the surfaces of the projections 74 adjacent the primary teeth 66 can conform in shape to and lay against the edge surfaces 63 of the blade of metal 60 adjacent the points 71 of the primary teeth 66, or alternatively, be spaced from the points 71 by the thickness of the blade 60.

The present invention has now been described with reference to several embodiments and possible modifications thereof It will be apparent to those skilled in the art that many changes can be made in the embodiments described without departing from the scope of the present invention. Thus, the scope of the present invention should not be limited to the structures described in this application, but only by the structures described by the language of the claims and the equivalents thereof.

What is claimed is:

1. A cut-off blade assembly having a sharp cutting edge for cutting sheet material, said cut-off blade assembly comprising a thin metal blade having opposite first and second major surfaces and edge surfaces extending between said major surfaces, said blade including an attachment portion and a plurality of similarly shaped triangular primary teeth, said primary teeth defining parts of said first major surface in the shapes of triangles, each of said teeth having two sides terminating in a point, and said teeth having bases adjacent said attachment portion and aligned in a first direction along said blade so that said points project generally at right angles to said first direction, said edge surfaces along said sides and at said points of said primary teeth being disposed at included angles of no greater than about 90 degrees with respect to said first surface to define at least a portion of a cutting edge for said blade at the intersection of said first major surface and said edge surfaces along said sides and at said points of said teeth, said cut-off blade assembly further including projections comprising portions along said primary teeth, said portions of said projections having distal ends positioned adjacent said points, having sufficient thickness adjacent said points in a direction normal to said major surfaces to restrict contact between said cutting edge at said points and a person using said cutting blade, and being shaped to only be positioned along said primary teeth without extending past the points of said primary teeth to afford cutting of sheet material pressed against said cutting edge by movement of sheet material over said primary teeth.

2. A cut-off blade assembly according to claim 1 wherein the points of adjacent primary teeth are spaced apart by a distance of up to about 0.4 inch or 1 centimeter, and said blade includes portions defining portions of said cutting edge for said blade between said adjacent primary teeth.

3. A cut-off blade assembly according to claim 2 wherein said portions of said blade defining portions of said cutting edge for said blade between said adjacent primary teeth comprise a plurality of secondary teeth having points projecting generally a right angles to said first direction and recessed in a direction normal to said first direction from the points of said primary teeth.

4. A cut-off blade assembly according to claim 1 wherein the points of adjacent primary teeth are spaced appart by a distance in the range of about 0.27 to 0.32 inch or 0.8 centimeter, said primary teeth have widths at said bases of about 0.09 inch or 0.23 centimeter and heights between said bases and said points of about 0.13 inch or 0.33 centimeter, and said blade includes portions defining portions of said cutting edge for said blade between said adjacent primary teeth comprising a plurality of secondary teeth having points projecting generally a right angles to said first direction, the points of said secondary teeth being recessed by about 0.065 inch or 0.17 centimeter from the points of said primary teeth in a direction normal to said first direction.

5. A cut-off blade assembly according to claim 1 wherein the sides of adjacent primary teeth intersect at the bases of the adjacent primary teeth to define a generally V shaped opening between said adjacent primary teeth.

6. A cut-off blade assembly according to claim 1 wherein the thicknesses of said projections adjacent said points are at least 0.02 inch or 0.05 centimeter and the distance along said primary teeth between said points and the distal ends of said projections is in the range of 0 to 0.01 inch or 0 to 0.025 centimeter.

7. A cut-off blade assembly according to claim 1 wherein the thicknesses of said projections adjacent said points are about 0.03 inch or 0.08 centimeter.

8. A cut-off blade assembly according to claim 1 wherein the thicknesses of said projections adjacent said points are at least 0.02 inch or 0.05 centimeter, said projections are portions of a layer of material also including a base portion, to which base portion are attached proximal ends of said projections opposite said distal ends.

9. A cut-off blade assembly according to claim 8 wherein the thicknesses of said projections adjacent said proximal ends are about 0.06 inch or 0.15 centimeter, and said projections are tapered to have widths generally corresponding with said sides of said primary teeth adjacent said points.

10. A cut-off blade assembly according to claim 1 wherein the thicknesses of said projections adjacent said points are about 0.03 inch or 0.08 centimeter, said projections are portions of a layer of material also including a base portion to which base portion are attached proximal ends of said projections opposite said distal ends, the thickness of said projections adjacent said proximal ends is at least 0.06 inch or 0.15 centimeter, and said projections have maximum widths of about 0.03 inch or 0.08 centimeter in a direction parallel to said first direction and are tapered to have widths generally corresponding with said sides of said primary teeth adjacent said points.

11. A dispenser from which sheet material having opposite major surfaces may be manually dispensed, said dispenser comprising:

a frame;

means on said frame adapted for carrying the sheet material and for defining a passageway having a first side generally parallel to said surfaces of said sheet material, through a portion of which passageway a portion of the sheet material carried on the frame can be pulled;

a cut-off blade assembly having a sharp cutting edge for transversely cutting the sheet material and being mounted on said frame along said first side of and transverse to said passageway, said cut-off blade assembly comprising a thin metal blade having generally parallel opposite first and second major surfaces and edge surfaces extending between said major surfaces, said metal blade including an attachment portion and a plurality of similarly shaped primary teeth, said primary teeth defining parts of said first major surface in the shapes of triangles, each of said teeth having two sides terminating in points, and said teeth having bases adjacent said attachment portion and aligned in a first direction along said blade so that said points project generally at right angles to said first direction, said edge surfaces along said sides and at said points of said teeth being disposed at included angles of no greater than about 90 degrees with respect to said first surface to define at least a portion of said cutting edge at the intersection of said first surface and said edge surfaces along said sides and at said points of said teeth, said cut-off blade assembly further including projections comprising portions along said primary teeth, said portions of said projections having distal ends positioned adjacent said points, having sufficient thickness adjacent said points in a direction normal to said major surfaces to restrict contact between said cutting edge at said points and a person using said cutting blade, and being shaped to only be positioned along said primary teeth without extending past the points of said primary teeth to afford cutting of sheet material pressed against said cutting edge along said first surface by movement of sheet material over said primary teeth.

12. A cut-off blade assembly according to claim 11 wherein the points of adjacent primary teeth are spaced appart by a distance of up to about 0.4 inch or 1 centimeter, and said blade includes portions defining portions of said cutting edge for said blade between said adjacent primary teeth.

13. A cut-off blade assembly according to claim 12 wherein said portions of said blade defining portions of said cutting edge for said blade between said adjacent primary teeth comprise a plurality of secondary teeth having points projecting generally a right angles to said first direction and recessed in a direction normal to said first direction from the points of said primary teeth.

14. A cut-off blade assembly according to claim 11 wherein the points of adjacent primary teeth are spaced apart by a distance in the range of about 0.27 to 0.32 inch or 0.8 centimeter, said primary teeth have widths at said bases of about 0.09 inch or 0.23 centimeter and heights between said bases and said points of about 0.13 inch or 0.33 centimeter, and said blade includes portions defining portions of said cutting edge for said blade between said adjacent primary teeth comprising a plurality of secondary teeth having points projecting generally a right angles to said first direction, the points of said secondary teeth being recessed by about 0.065 inch or 0.17 centimeter from the points of said primary teeth in a direction normal to said first direction.

15. A cut-off blade assembly according to claim 11 wherein the sides of adjacent primary teeth intersect at the bases of the adjacent primary teeth to define a generally V shaped opening between said adjacent primary teeth.

16. A cut-off blade assembly according to claim 11 wherein the thicknesses of said projections adjacent said points are at least 0.02 inch or 0.05 centimeter and the distance along said primary teeth between said points and the distal ends of said projections is in the range of 0 to 0.01 inch or 0 to 0.025 centimeter.

17. A cut-off blade assembly according to claim 11 wherein the thicknesses of said projections adjacent said points are about 0.03 inch or 0.08 centimeter.

18. A cut-off blade assembly according to claim 11 wherein the thicknesses of said projections adjacent said points are at least 0.02 inch or 0.05 centimeter, said projections are portions of a layer of material also including a base portion, to which base portion are attached proximal ends of said projections opposite said distal ends.

19. A cut-off blade assembly according to claim 18 wherein the thickness thicknesses of said projections adjacent said proximal ends are about 0.06 inch or 0.15 centimeter, and said projections are tapered to have widths generally corresponding with said sides of said primary teeth adjacent said points.

20. A cut-off blade assembly according to claim 11 wherein the thicknesses of said projections adjacent said points are about 0.03 inch or 0.08 centimeter, said projections are portions of a layer of material also including a base portion to which base portion are attached proximal ends of said projections opposite said distal ends, the thickness of said projections adjacent said proximal ends is at least 0.06 inch or 0.15 centimeter, and said projections have maximum widths of about 0.03 inch or 0.08 centimeter in a direction parallel to said first direction and are tapered to have widths generally corresponding with said sides of said primary teeth adjacent said points.

* * * * *

UNITED STATES PATENT AND TRADEMARK OFFICE

CERTIFICATE OF CORRECTION

PATENT NO. : 6,367,533 B1
DATED : April 9, 2002
INVENTOR(S) : Pitzen, James F.

It is certified that error appears in the above-identified patent and that said Letters Patent is hereby corrected as shown below:

Column 2,
Line 21, delete “persons flesh” and insert in place thereof -- person’s flesh --.
Line 25, delete “persons flesh” and insert in place thereof -- person’s flesh --.
Line 34, delete “requireing” and insert in place thereof -- requiring --.

Column 3,
Line 16, delete “my” and insert in place thereof -- by --.

Column 5,
Line 31, delete “0.03 in” and insert in place thereof -- 0.03 inch --.
Line 32, delete “0.03 in” and insert in place thereof -- 0.03 inch --.
Line 37, delete “interfearance” and insert in place thereof -- interference --.

Column 6,
Line 54, delete “a right” and insert in place thereof -- at right --.

Column 7,
Line 50, delete “a right” and insert in place thereof -- at right --.
Line 61, delete “interfearance” and insert in place thereof -- interference --.

Column 9,
Line 5, delete “a right” and insert in place thereof -- at right --.
Line 16, delete “a right” and insert in place thereof -- at right --.

Column 10,
Line 42, delete “a right” and insert in place thereof -- at right --.
Line 54, delete “a right” and insert in place thereof -- at right --.

Signed and Sealed this

Sixth Day of August, 2002

*Attest:*

*Attesting Officer*

JAMES E. ROGAN
*Director of the United States Patent and Trademark Office*